United States Patent [19]

Pignatti

[11] 4,271,772

[45] Jun. 9, 1981

[54] SEWING MACHINE ATTACHMENT FOR EDGINGS AND COLLARS

[76] Inventor: Ugo Pignatti, Via M. Buonarroti, 2, 46024 Moglia (Mantova), Italy

[21] Appl. No.: 940,964

[22] Filed: Sep. 11, 1978

[30] Foreign Application Priority Data

Sep. 14, 1977 [IT] Italy ..... 22209/77[U]

[51] Int. Cl.[3] ..... D05B 35/06

[52] U.S. Cl. ..... 112/137; 112/147; 112/141; 112/152

[58] Field of Search ..... 112/121.26, 136, 147, 112/148, 149, 137, 141, 142, 143, 152, 153, 140

[56] References Cited

U.S. PATENT DOCUMENTS

| | | | |
|---|---|---|---|
| 1,531,024 | 3/1925 | Phillips | 112/147 |
| 1,987,384 | 1/1935 | Ackerman et al. | 112/147 |
| 2,011,512 | 8/1935 | Carmichael | 112/137 X |
| 2,651,793 | 9/1953 | Tenge | 112/137 X |
| 3,658,020 | 4/1972 | Marforio | 112/147 |
| 3,974,788 | 8/1976 | Pignatti et al. | 112/141 X |

*Primary Examiner*—Werner H. Schroeder
*Assistant Examiner*—Andrew M. Falik
*Attorney, Agent, or Firm*—Bucknam and Archer

[57] ABSTRACT

A device for quickly sewing finishing elements such as edgings and collars onto knitted outerwear articles to be applied on chainstitch sewing machines comprises: (a) a braking member for the finishing element effective to maintain it in a tensioned or stretched condition; (b) a folding or bending member effective to fold or bend said finishing element, and (c) a feeding member effective to feed the folded or bent finishing element and the knitted article, under the foot of the sewing machine. The braking member is formed by a curved rod, onto the bottom of which presses a blade spring, and by two parallel vertical rods located upstream of the first rod, the finishing element passing at first between said two rods and then, together with the selvedge, between the curved rod and blade spring. The pressure exerted by the blade spring on the rod may be adjusted by a screw provided with a spring.

7 Claims, 6 Drawing Figures

Figures 1, 2:
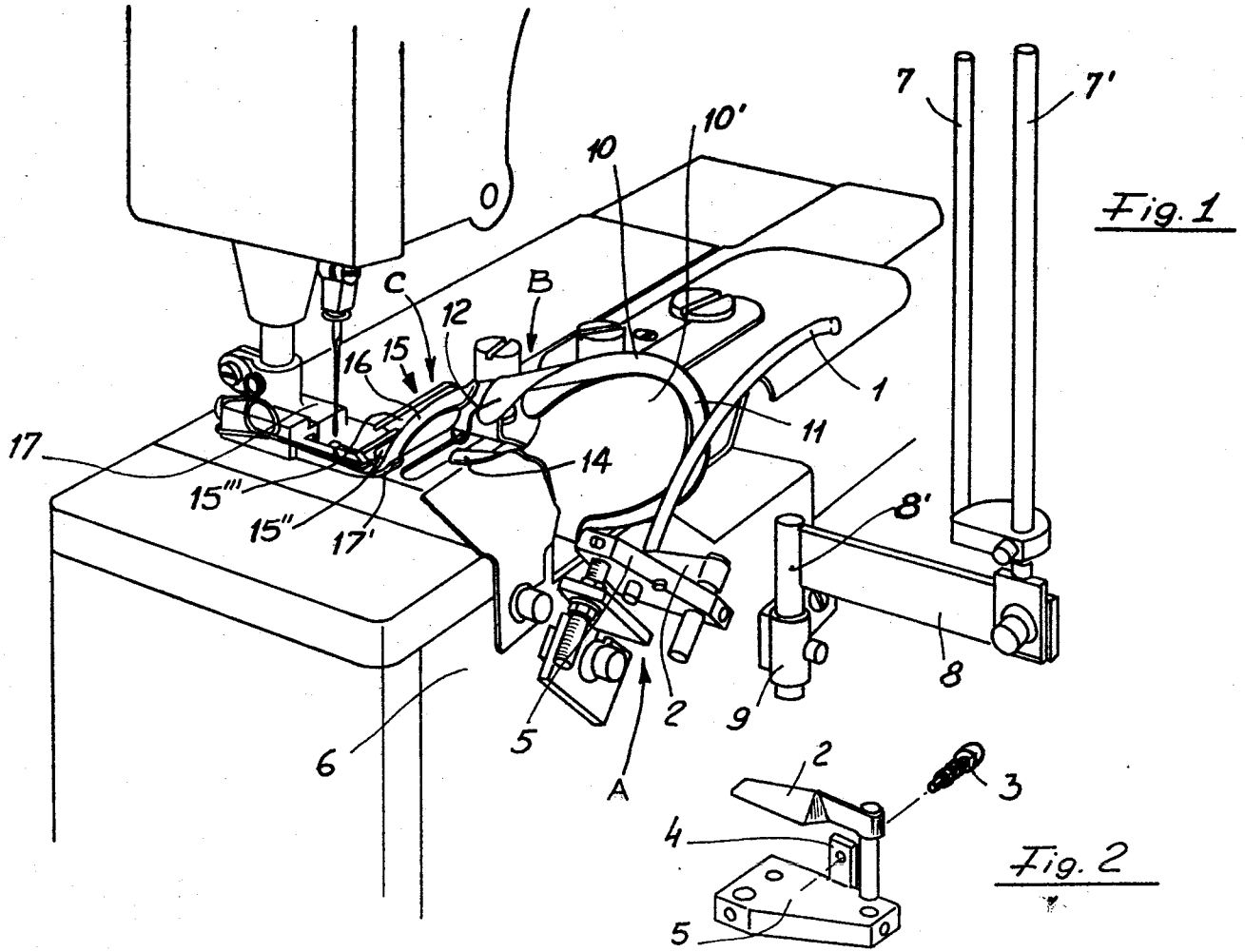

7'
7
1
8'
8
11
10'
10
9
2
A
14
B
12
C
15
16
17'
15''
15'''
17
5
6
3
4

18
18'
22
21
24
E
D
19
23
26
25
27
20
25'
25''
26'

SEWING MACHINE ATTACHMENT FOR EDGINGS AND COLLARS

The present invention relates to a device effective to be applied on sewing machines for quickly sewing edgings and collars.

More particularly, the present invention relates to a device for quickly sewing edgings and collars on knitted outerwear articles, effective to be applied on chain-stitch sewing machines.

As it is known, the knitted outerwear articles are generally provided with knitted edgings at the neck and sleeve portions.

Analogously, to the knitted jackets are applied, about the neck and/or at the sleeve ends, collars or dummy members, which may be either of a single type, i.e. turned over, or of a double type.

The application of the edgings and/or finishing collars is nowadays carried out by means of special looping machines which are of a comparatively high cost, intricate and moreover they require continuous monitoring and maintenance.

The use, in the finishing operations, of the conventional single or double chain-stitch sewing machines, does not allow for satisfactory results to be obtained because the finishing element undergoes excessive stretching.

Furthermore, on the conventional chain-stitch machines, the edging of the knitted article to be handled has to be preliminarly treated by tubular stitch turns in order to facilitate the folding at the desired height. U.S. Pat. No. 3,974,788 describes an attachment which, when fitted to an ordinary sewing machine making the chain stitch, permits the sewing machine to sew borders or collars to knitwear without initial preparation. The apparatus includes means for imparting to the borders or collars a folded configuration prior to being placed under the sewing needle, but does not include braking means for preshaping the finishing element nor a folding member capable of folding one finishing element to form a C and then providing an upturned portion.

It is an object of the present invention to adapt a conventional chain stitch sewing machine for the application of edgings and collars to knitted outerwear articles.

More specifically, the object of the present invention is to provide a device effective to be applied on a conventional chain stitch sewing machine, and able to allow for the sewing machine to easily and quickly sew edgings, collars and like finishing members to knitted outerwear articles, while avoiding the need of treating said knitted outerwear articles by turns of tubular stitches.

The Applicant has found that this object is achieved by applying to a conventional chain stitch sewing machine, a device essentially comprising, in the feeding direction towards the sewing machine foot member: a braking member effective to brake the edging or collar or in general the finishing element to be applied, at the lower portion thereof, i.e. the selvedge, effective to maintain said finishing element in a perfectly stretched condition; a stretched finishing element bending or folding member, and a feeding member effective to feed or forward the folded finishing element, jointly to the knitted article to be finished, under the sewing machine foot member.

Figure 1A:
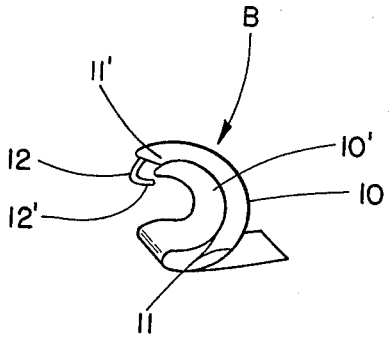
Figure 1B:
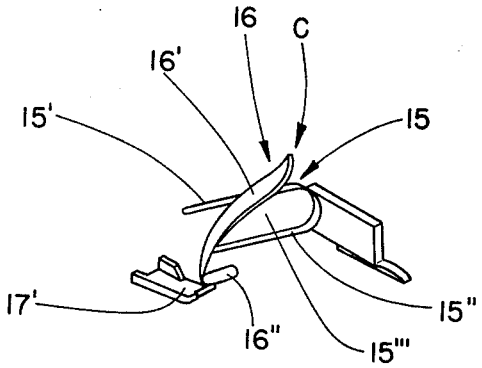
Figures 3, 4:
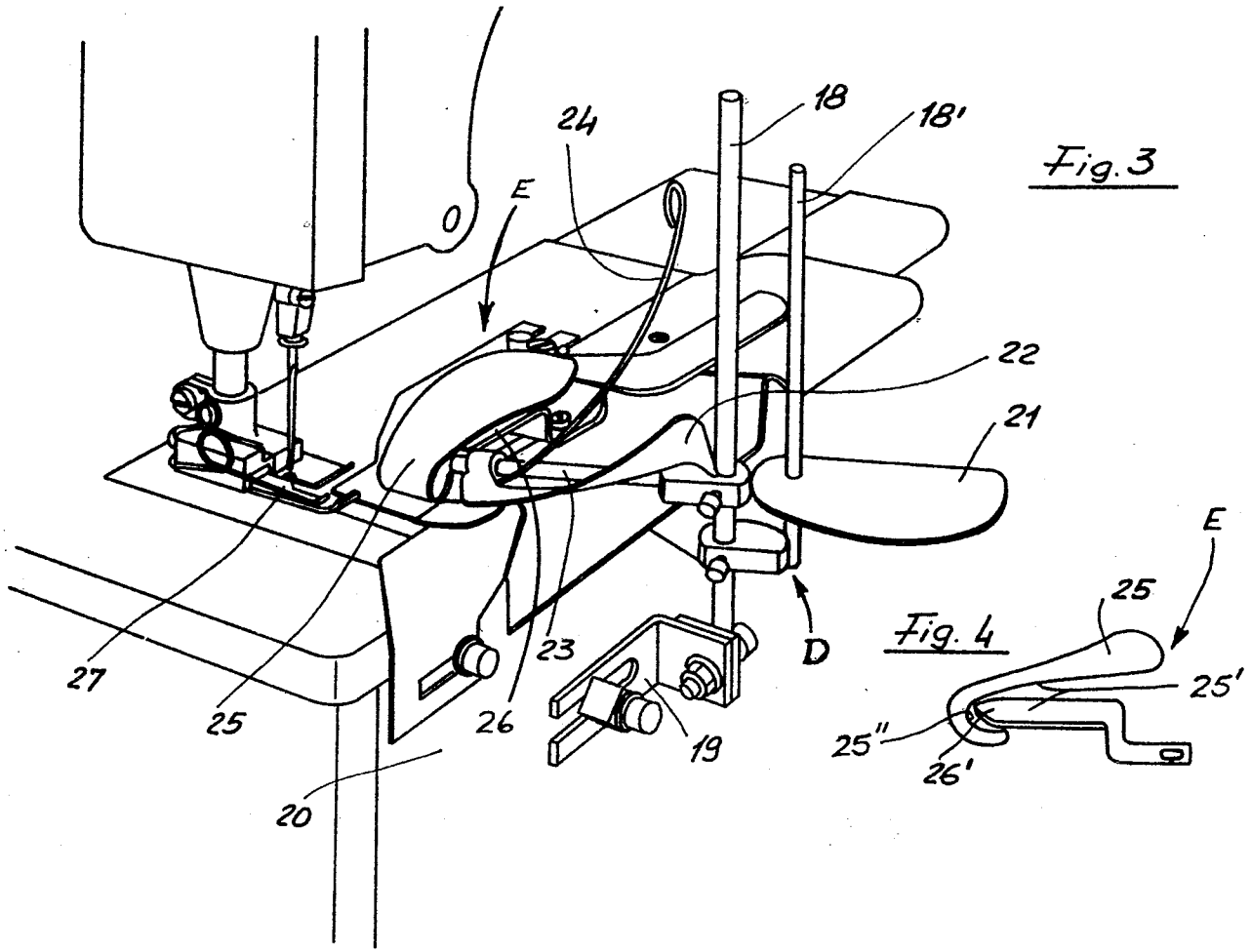

In order to better understand the functional and constructional characteristics of the device effective to be applied to a conventional sewing machine, according to the present invention, the accompanying drawing figures illustrate two preferred exemplificative and not limitative embodiments, where:

FIG. 1 schematically illustrates a embodiment of the device according to the present invention as mounted on a conventional sewing machine;

FIG. 1*a* illustrates in detail the bending or folding element;

FIG. 1*b* illustrates in detail the guiding element and specifically the foot of the sewing machine;

FIG. 2 particularly illustrates the braking member associated to the device of FIG. 1;

FIG. 3 schematically illustrates another embodiment of the instant device, as mounted on a conventional sewing machine, and FIG. 4 particularly illustrates the folding or bending member associated with the device of FIG. 3.

The device consists essentially of three parts:

(1) The portion designated by the letter A which is essentially a braking member, serving the function of pre-shaping the finishing element and braking that edge of the latter which has to be sewn to the inner portion of the article. This braking member maintains the finishing element in a stretched condition.

(2) The second portion designated by the letter B is a bending or folding member, and specifically serves the purpose of forming the desired fold on the finishing element. The upper border of the finishing element is folded downwardly and towards the interior, to the right in FIG. 1*a*, by the element 12 while the other border of the finishing element is folded downwardly and to the left in FIG. 1*a* under the border of the article to be finished.

(3) The third portion labeled C serves the function of maintaining the folds until the finishing element has been sewn on the knitted article at the proper place by the foot member of the sewing machine.

As shown in FIGS. 1 and 2, the device comprises curved rod 1 at the bottom portion of which is blade spring 2. Screw 3 serves the function of adjusting the pressure of the blade spring on the rod. The screw 3 threads in a cranked ridge 4 which is rigid with plate 5. The plate is fixed to the front portion of the plane 6 of the sewing machine. Upstream of the rod 1 are provided two parallel small rods 7 and 7', which, by means of arm 8, cranked element 8' and collar 9, are connected to the front plane 6 of the sewing machine. The edging or collar to be applied slides between the two rods 7 and 7' and then moves between the bottom of rod 1 and blade spring 2, is braked and maintained under tension by the screw 3.

The folding member B is located downstream of rod 1 and is formed by two outer and inner helical portions 10 and 10' which delineate a curved slot 11. The finishing element passes through slot 11. Steel wire 12 is bent and projects downwardly, acting as a folding member to fold or bend the upturned upper portion of the finishing element, an edging or a collar.

As shown in FIGS. 1 and 1*a*, the second portion B is located downstream of rod 1. This member is of the type which can turn one edge of a binding strip. FIG. 1*a* shows that this member B is formed by two helical surface portions 10 and 10' which are funnel-shaped. The steel wire 12 is located on the upper part of the outer surface portion 10 and across the open part 11' of the slot 11. The steel wire is fitted with a portion 12' which projects inwardly so that it bends the edge of the finishing element which is opposite to the stretched edge and which has to be sewn. The cloth guiding element 13 is located under the steel element 12. Member 13 is provided with curved end 14 and serves the function of locating the edge of the knitted article exactly between the folded portions of the finishing element.

The third part of the apparatus has been labeled C. The folded or bent finishing element passes in this part of the apparatus C through a guiding means formed by a scroll plate 16 and forked element 15. This is shown in detail in FIG. 1*b*. Numerals 15' and 15'' designate the two arms of the fork 15 and numeral 15''' designates the oval-shaped passage. The scroll plate 16 is rigid with the portion 17' which is part of foot member 17 of the sewing machine. The scroll plate 16 is formed by portion 16' which is curved upwardly and a small horizontal portion 16'' so that the fold formed by the steel wire element 12 is maintained. The two arms 15' and 15'' of element 15 are arranged opposite to the scroll element 16 for maintaining the finishing element in pressed and unchanged condition prior to reaching the foot member 17. The fork member 15 and scroll plate 16 form an oval-shaped passage 15''' which serves as guide for the finishing element and for locating the portion to be sewn under foot 17.

FIGS. 3 and 4 illustrate another embodiment of the device of the present invention. In the figures, the different portions of the apparatus are designated by letters D, E and F respectively. It comprises two parallel vertical small rods 18 and 18' which are fixed by means of cranked element 19 to the front plane 20 of the sewing machine. Numeral 21 designates the blade of oval shape. The blade together with rods 18 and 18' acts as the braking member. Member 22 is fixed to rod 18 at one end and at the other end to a pin 23. At the end of pin 23 is located curved rod 24 acting to fold or bend the edging or collar. Downstream of the sliding element 22 is located guide 25 formed by a partially helically curved fin. The punch 26 projects in the inner portion of the fin and conveys the bent finishing element under foot member 27.

In the embodiment of FIGS. 3 and 4, the curved rod 24 is located at the end of pin 23. The second part or folding member E is located downstream of element 22. This folding member is formed by the partially helically curved fin 25. The elongated member 26 is located in the inner portion of the fin in a manner as to leave a space, as shown in FIG. 4. The end portion 26' of element 26 forms with the fin 25 a curved portion 25'' of the passageway 25' in which the finishing element edge passes. The passageway 25' conveys the bent finishing element under foot member 27.

The steel wire 12 and the passageway portion 24'' of member E are capable of folding under the edge of the finishing element which is usually backing the selvedge, that is that edge in which the knitted stitches are opened. In accordance with the apparatus of the present invention, it is possible to apply on the right side of a knitted article a pre-folded strip of the same material which may remain oriented due to the backing action of member A or D.

The thereinabove described and illustrated embodiments of the instant device are only indicative and not limitative examples of the practicing of the present invention. Accordingly several shape, size and construction modifications and variations may be carried in the several elements forming the instant device, within the spirit of the present invention and without departing from the scope thereof.

I claim:

1. A sewing machine attachment effective to be applied to a sewing machine for sewing edgings, collars and like finishing elements to knitted outwear articles, which comprises, in the feeding direction, a pre-shaping portion fitted with a braking member applied at the lower edge of the finishing element and effective to maintain the finishing element in an exactly tensioned or stretched condition; a second portion fitted with a folding or bending member effective to fold or bend the raw edge of said finishing element opposite to said lower edge having loops to form a fold having two members, and a third portion fitted with guiding means effective to guide the folded or bent edge of said finishing element in alignment with the knitted article to be sewn, whereby said knitted article is interposed between said two members of said fold, wherein said braking member is formed by a curved rod, onto the bottom of which urges a blade spring and by two parallel vertical rods located upstream of said curved rod.

2. The attachment according to claim 1, wherein said guiding means comprises a scroll portion element provided with a vertical curved end and a small horizontal portion, and a forked shaped element provided with two arms arranged downstream and in opposition to said vertical curved end.

3. The attachment according to claim 1, wherein said braking member is formed by two parallel vertical rods, fixed to the front plane of the sewing machine, and by an oval blade structure, longitudinally angled, fixed to one of said two rods.

4. The attachment according to claim 1, wherein said preshaping means comprises a curved rod fixed to a pin, said pin pivoting a curved and shaped element.

5. The attachment according to claim 1, wherein said folding or bending member consists of a partially helically curved fin, in the interior of which projects an end portion of an elongated element arranged substantially coplanar and spaced apart with respect to said fin.

6. The attachment according to claim 1, which comprises means for adjusting the pressure exercised by the blade spring on said curved rod, said means comprising a screw provided with a spring acting against the pressure on the curved rod by said blade.

7. An attachment according to claim 1, wherein the folding or bending member is formed by two substantially funnel shaped helical surface portions defining a curved slot, the finishing element to be applied has an upper upturned portion, and the attachment comprises a bent and downwardly projecting steel wire, aligned with said upper upturned portion and causing said upper upturned portion to pass through said curved slot, said steel wire being fixed to the outer helical surface and acting on said upper upturned portion of the finishing element to be applied, in such a way to bend said raw edge of said finishing element having loops.

* * * * *